US006637858B2

(12) United States Patent
Wotton et al.

(10) Patent No.: US 6,637,858 B2
(45) Date of Patent: Oct. 28, 2003

(54) PRINTING MECHANISM HINGED PRINTBAR ASSEMBLY

(75) Inventors: Geoff M. Wotton, Battleground, WA (US); John A. Barinaga, Portland, OR (US); Daniel J. Fredrickson, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 114 days.

(21) Appl. No.: 10/016,466

(22) Filed: Oct. 30, 2001

(65) Prior Publication Data

US 2003/0081055 A1 May 1, 2003

(51) Int. Cl.[7] ..... B41J 2/165; B41J 2/155

(52) U.S. Cl. ..... 347/33; 347/42; 347/29

(58) Field of Search ..... 347/42, 29, 33, 347/32, 22

(56) References Cited

U.S. PATENT DOCUMENTS 5,206,666 A * 4/1993 Watanabe et al. ..... 347/3
5,534,897 A * 7/1996 Anderson et al. ..... 347/32

* cited by examiner

*Primary Examiner*—Thinh Nguyen
(74) *Attorney, Agent, or Firm*—Lee & Hayes, PLLC

(57) ABSTRACT

A print unit, such as an inkjet printing mechanism, includes a hinged printbar assembly that has print modules with one or more printheads to deposit an imaging medium, such as ink, onto a print media. The one or more printheads of the print modules collectively span a width of a print media when the hinged printbar assembly is in a print position. The hinged printbar assembly pivots about a hinge from the print position to a service position to provide service access to the one or more printheads of the print modules. The print unit also includes a wiper assembly having one or more wipers that correspond to the one or more printheads, such that when the wiper assembly and the print module are positioned in the service position, the wipers clean the printheads.

29 Claims, 8 Drawing Sheets

PRINTING MECHANISM HINGED PRINTBAR ASSEMBLY

TECHNICAL FIELD

This invention relates to printing mechanisms and, in particular, to hinged page wide array printbars and a wiper assembly.

BACKGROUND

An inkjet printer includes a printing assembly having a printhead, or printheads, to deposit ink onto a print media, such as paper. A printhead has an orifice plate that is formed with nozzles through which ink drops are "fired", or otherwise ejected, onto the print media to form an image, such as text or a picture. The ink drops dry, or are heated to dry, on the print media shortly after deposition to form the printed image.

There are various types of inkjet printheads including, for example, thermal inkjet printheads and piezoelectric inkjet printheads. For a thermal inkjet printhead, ink droplets are ejected from individual nozzles by localized heating with a heating element located at individual nozzles. An electric current is applied to a heating element to heat it up which causes a small volume of ink to be rapidly heated and vaporized. Once vaporized, the ink is ejected through the nozzle. A driver circuit is coupled to individual heating elements to provide the energy pulses and thereby controllably deposit ink drops from associated individual nozzles. The drivers are responsive to character generators and other image forming circuitry to energize selected nozzles of a printhead for forming images on the print media.

During printing, ink tends to build up at the nozzle orifices of a printhead. This build-up of residual ink can be caused by ink droplets that are not completely ejected from a nozzle, excess ink at the orifice that is not fully vaporized, or ink spatterings that reflect from the print media when the ink is ejected. The small nozzle orifices of a printhead are also susceptible to clogging by quick drying ink, dust particles and paper fibers, and from solids within the ink. Partially or completely blocked nozzles can result in either missing or misdirected ink drops being deposited onto the print media, either of which impairs printing and degrades the print quality.

The printing assembly typically includes a service station having wipers to clean and preserve the functionality of the printheads. The service station includes a wiper, or wipers, for wiping a printhead to remove ink residue and other contaminants that have been deposited or collected on the printhead surface and over the nozzle openings in the printhead surface. A service station can also include a cap, or capping mechanism, which covers a printhead when the printer is not printing to prevent the ink in the nozzles from drying, and to prevent contaminants from collecting in and over the nozzles.

A conventional inkjet printer has a print unit that includes a reciprocating inkjet pen carriage system for travel back and forth across a print zone along an axis that spans a print media, or otherwise spans a printing width. A conventional print unit also includes a service station fixed within the inkjet printer away from the print zone. To service the printhead nozzles of the inkjet pen carriage system, the carriage system travels along the axis and away from the print zone, or outside of the print zone, to the service station.

With the advent of page wide array printbar assemblies having multiple printheads that span the width of a print media, or otherwise span a printing width, there is a need for improved printing mechanisms having printbar assemblies that are accessible to clean the multiple printheads, and service station assemblies that move wipers and printhead caps to the printheads, rather than the printheads being moved to the wipers at a service station.

SUMMARY

A print unit, such as an inkjet printing mechanism, includes a hinged printbar assembly that has print modules with one or more printheads to deposit an imaging medium, such as ink, onto a print media. The one or more printheads of the print modules collectively span a width of a print media when the hinged printbar assembly is in a print position. The hinged printbar assembly pivots about a hinge from the print position to a service position to provide service access to the one or more printheads of the print modules.

The print unit also includes a wiper assembly having one or more wipers that correspond to the one or more printheads, such that when the wiper assembly and the print module are positioned in the service position, the wipers clean the printheads of ink residue and contaminants. The wiper assembly has a guidable member that engages a wiper assembly servicing guide to guide the wipers when cleaning the printheads. The wiper assembly servicing guide can include a channel guide within the hinged printbar assembly, or a guide component configured external to the hinged printbar assembly. The wiper assembly servicing guide and the guidable member interact to maintain contact between the one or more wipers and the one or more printheads of the print modules.

BRIEF DESCRIPTION OF THE DRAWINGS

The same numbers are used throughout the drawings to reference like features and components.

DETAILED DESCRIPTION

Introduction

The following describes systems and methods for a printing mechanism having hinged printbar assemblies and corresponding wiper assemblies to clean printheads on print modules coupled to a hinged printbar assembly. A printbar assembly, also referred to as a page wide array printbar, has printheads that overlap for continuous printing across the width of a print media, and is capable of printing more pages at a faster rate than conventional scanning, or reciprocating, type pen carriage systems that travel back and forth across a print zone to print. A printbar assembly can be pivoted about a hinge from a print position to a service position to provide service access to printheads on the printbar assembly. In the service position, a wiper assembly can engage the printbar assembly to clean the printheads with wipers and/or cover the printheads with printhead caps. The hinged printbar assembly described herein, and the coordination with a wiper assembly, can be implemented in many different printing devices, to include inkjet printing devices.

Exemplary Printer Architecture

Figure 1:
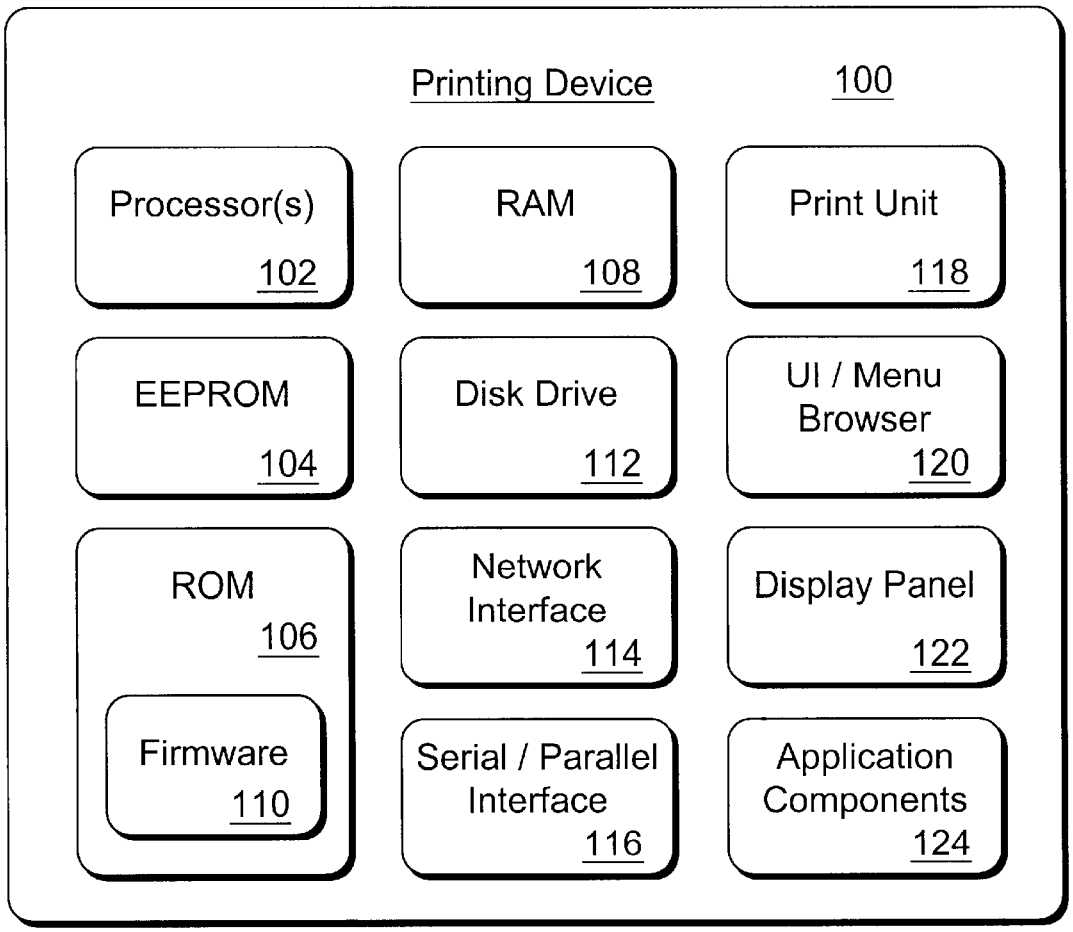
FIG. 1 is block diagram that illustrates various components of an exemplary printing device.

FIG. 1 illustrates various components of an exemplary printing device 100 that can be utilized to implement the inventive techniques described herein. Printer 100 includes one or more processors 102, an electrically erasable programmable read-only memory (EEPROM) 104, ROM 106 (non-erasable), and a random access memory (RAM) 108. Although printer 100 is illustrated having an EEPROM 104 and ROM 106, a particular printer may only include one of the memory components. Additionally, although not shown, a system bus typically connects the various components within the printing device 100.

The printer 100 also has a firmware component 110 that is implemented as a permanent memory module stored on ROM 106. The firmware 110 is programmed and tested like software, and is distributed with the printer 100. The firmware 110 can be implemented to coordinate operations of the hardware within printer 100 and contains programming constructs used to perform such operations.

Processor(s) 102 process various instructions to control the operation of the printer 100 and to communicate with other electronic and computing devices. The memory components, EEPROM 104, ROM 106, and RAM 108, store various information and/or data such as configuration information, fonts, templates, data being printed, and menu structure information. Although not shown, a particular printer can also include a flash memory device in place of or in addition to EEPROM 104 and ROM 106.

Printer 100 also includes a disk drive 112, a network interface 114, and a serial/parallel interface 116. Disk drive 112 provides additional storage for data being printed or other information maintained by the printer 100. Although printer 100 is illustrated having both RAM 108 and a disk drive 112, a particular printer may include either RAM 108 or disk drive 112, depending on the storage needs of the printer. For example, an inexpensive printer may include a small amount of RAM 108 and no disk drive 112, thereby reducing the manufacturing cost of the printer.

Network interface 114 provides a connection between printer 100 and a data communication network. The network interface 114 allows devices coupled to a common data communication network to send print jobs, menu data, and other information to printer 100 via the network. Similarly, serial/parallel interface 116 provides a data communication path directly between printer 100 and another electronic or computing device. Although printer 100 is illustrated having a network interface 114 and serial/parallel interface 116, a particular printer may only include one interface component.

Printer 100 also includes a print unit 118 that includes mechanisms arranged to selectively apply an imaging medium such as liquid ink, toner, and the like to a print media in accordance with print data corresponding to a print job. Print media can include any form of media used for printing such as paper, plastic, fabric, Mylar, transparencies, and the like, and different sizes and types such as 8½×11, A4, roll feed media, etc. For example, print unit 118 can include an inkjet printing mechanism that selectively causes ink to be applied to a print media in a controlled fashion. The ink on the print media can then be more permanently fixed to the print media, for example, by selectively applying conductive or radiant thermal energy to the ink. Those skilled in the art will recognize that there are many different types of print units available, and that for the purposes of the present invention, print unit 118 can include any of these different types.

Printer 100 also includes a user interface and menu browser 120, and a display panel 122. The user interface and menu browser 120 allows a user of the printer 100 to navigate the printer's menu structure. User interface 120 can be indicators or a series of buttons, switches, or other selectable controls that are manipulated by a user of the printer. Display panel 122 is a graphical display that provides information regarding the status of the printer 100 and the current options available to a user through the menu structure.

Printer 100 can, and typically does include application components 124 that provide a runtime environment in which software applications or applets can run or execute. Those skilled in the art will recognize that there are many different types of runtime environments available. A runtime environment facilitates the extensibility of printer 100 by allowing various interfaces to be defined that, in turn, allow the application components 124 to interact with the printer.

General reference is made herein to one or more printing devices, such as printing device 100. As used herein, "printing device" means any electronic device having data communications, data storage capabilities, and/or functions to render printed characters and images on a print media. A printing device may be a printer, fax machine, copier, plotter, and the like. The term "printer" includes any type of printing device using a transferred imaging medium, such as ejected ink, to create an image on a print media, and using a wiper assembly to clean imaging medium residue from an imaging medium applicator. Examples of such a printer can include, but are not limited to, inkjet printers, dry medium printers, copiers, facsimile machines, plotters, portable printing devices, cameras, and video printers, as well as multifunction devices such as a combination facsimile/printer or facsimile/scanner. Although specific examples may refer to one or more of these printers, such examples are not meant to limit the scope of the claims or the description, but are meant to provide a specific understanding of the described implementations.

Exemplary Printing Device

Figure 2:
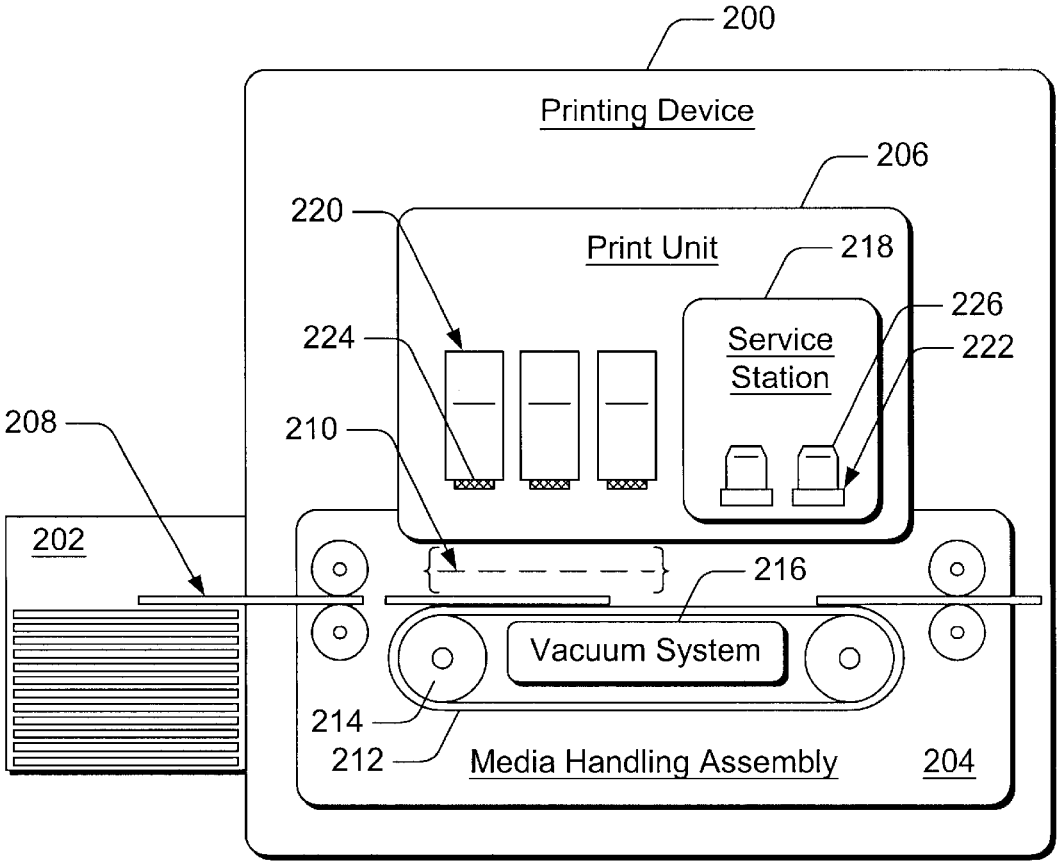
FIG. 2 is an illustration of various components of an exemplary printing device.

FIG. 2 illustrates a printing device 200 that can include one or more of the components of the exemplary printing device 100 (FIG. 1). The various exemplary printing device configurations are described in the environment and context of an inkjet printing device. While it is apparent that printing device components vary from one device to the next, those skilled in the art will recognize the applicability of the present invention to printing devices in general.

Printing device 200 includes a print media container 202, a media handling assembly 204, and a print unit 206. The print media container 202 holds print media 208 until the media handling assembly 204 takes up a print media and routes it through the printing device 200 for printing. The physical path of the print media through a printer is typically referred to as the "print path" or "print media path". When the print media 208 is routed within printing device 200 by the media handling assembly 204, the print media passes through a print region 210 in the printing device. Within print region 210, an imaging medium, such as ink, is transferred from the print unit 206 to print media 208 in response to the printing device 200 receiving print data corresponding to a print job.

The media handling assembly 204 includes components to route print media 208 through the printing device 200. The media handling assembly components include a media routing belt 212 that is positioned to route the print media 208 through the print region 210. The media routing belt 212 can be formed of a metal material, or other material that withstands the structural demands imposed by the printing process, to include localized heat that is generated to permanently fix an imaging medium, such as ink, to a print media.

The media routing belt 212 is driven by a belt drive and/or pulley and roller system 214 which is coupled to a motor drive unit (not shown). Those skilled in the art will recognize that there are any number of media handling assembly configurations that can be implemented in any number of printing devices to route print media through a printing device.

The media handling assembly also includes a vacuum system 216 to hold a print media 208 on the media routing belt 212 while the print media 208 is routed through the printing device 200. The media routing belt 212 can be perforated, or otherwise facilitate air flow through it, such that the vacuum system 216 located underneath the belt can hold the print media 208 on top of the belt while the print media is routed through the print region 210.

Figure 3:
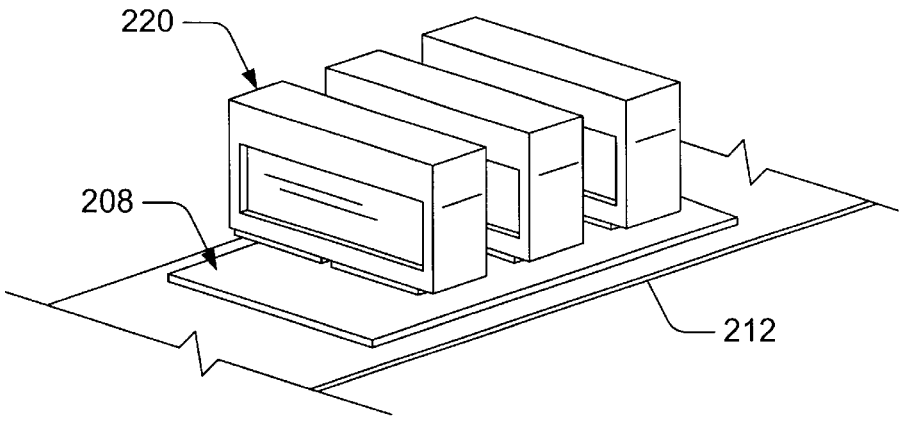
FIG. 3 is an illustration of printbar assemblies positioned for printing a print media.

Print unit 206 includes a service station 218 and a printbar assembly 220. The print unit 206 can have one or more printbar assemblies to deposit an imaging medium onto a print media 208 within the print region 210. Printbar assembly 220 is illustrated from an end-view, and spans the width of a print media 208 as the print media is routed in printing device 200. FIG. 3 illustrates a configuration of more than one printbar assembly 220 positioned for printing over a print media 208 that is routed in printing device 200 via the media routing belt 212.

Service station 218 includes a wiper assembly 222 that is mounted on, coupled to, and/or integrated with service station 218 to clean nozzle sections of printheads 224 on the printbar assembly 220. A wiper assembly 222 has wipers 226 to clean the printheads 224 and remove ink residue and contaminants to maintain a desired printing quality.

The printheads 224 are cleaned periodically during operation of printing device 200. A processor, or processors, in printing device 200 schedules routine servicing of the printheads based upon the printing time, the number of ink drops being ejected, and/or other printing related factors. For example, the printheads can be cleaned after an approximate time duration, such as after every ten minutes of printing time, or the printheads can be cleaned after a number of print media pages are printed, such as after every one-hundred pages. The service station 218 can have multiple wiper assemblies corresponding to multiple printbar assemblies in print unit 206.

Exemplary Printbar Assembly

Figure 4:
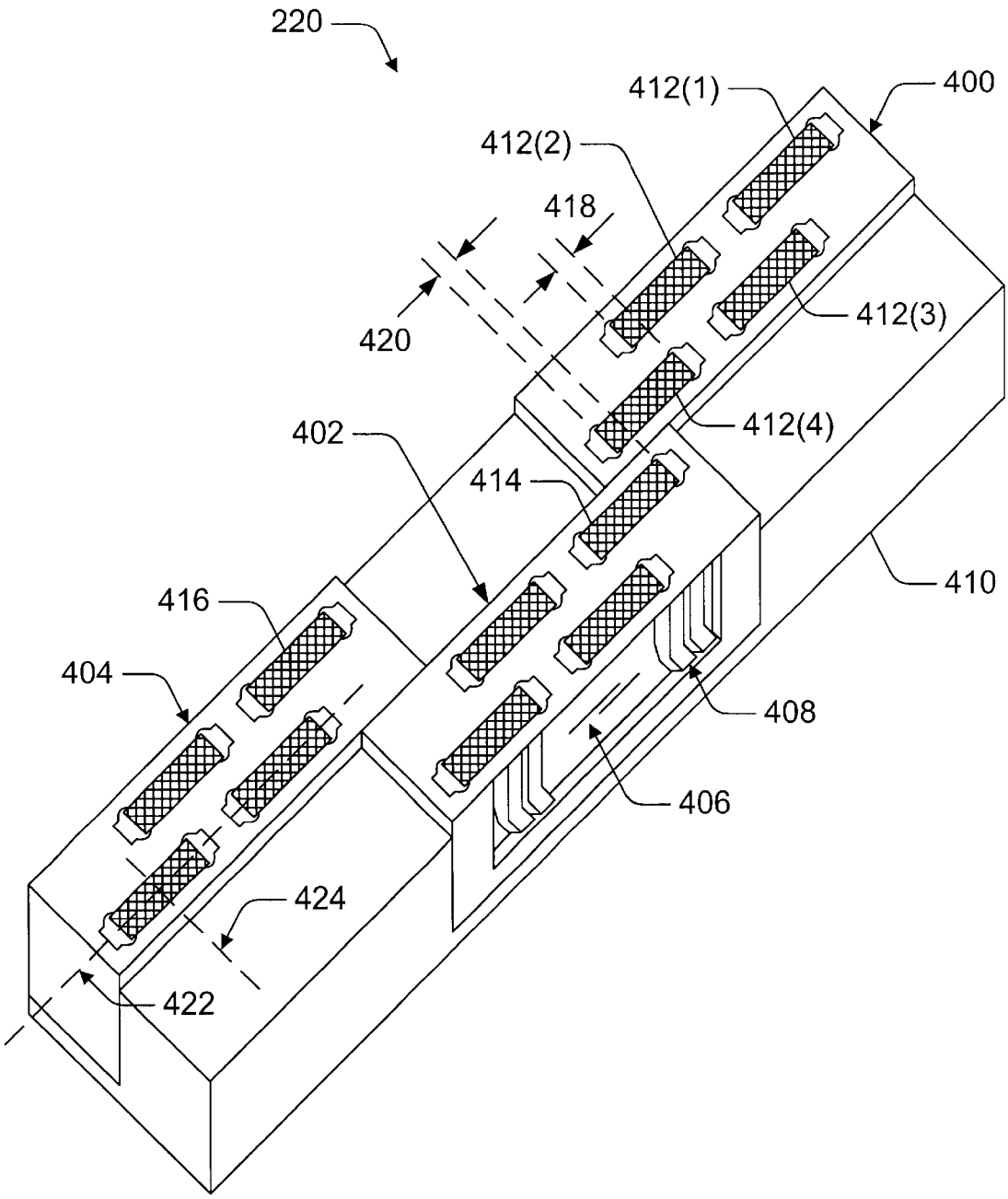
FIG. 4 is an illustration of an exemplary printbar assembly having print modules and multiple printheads.

FIG. 4 illustrates components of an exemplary printbar assembly 220. The printbar assembly 220 is shown having three print modules 400, 402, and 404, although any number of print modules can be combined in a printbar assembly to span the width of a print media, a print region, or span a printing width. A print module is also commonly referred to as a "cartridge", or a "pen". Conventionally, a print module includes an ink reservoir 406 to store a supply of ink and electrical connectors 408 to receive printing control signals from one or more printing device processors.

The printbar assembly 220 has a framework 410 to support and align the print modules, and to install the printbar assembly in a printing device. Those skilled in the art will recognize that any number of varying framework configurations can be implemented to support the print modules, and the printbar assembly in a printing device.

A print module, such as print module 400, has any number of printheads 412, each having multiple nozzles that eject ink onto a print media to form an image. A printhead is also commonly referred to as a "die". Print module 402 has multiple printheads such as printhead 414, and print module 404 has multiple printheads such as printhead 416. Each printhead has a longitudinal axis 422 and a transverse axis 424.

Collectively, the printheads on print bar assembly 220 span a printing width, a print region, or a print media width, and overlap to effectively deposit or transfer an imaging medium across the printing width without gaps in the imaging medium. The printheads on an individual print module overlap, and the printheads on adjacent print modules overlap. For example printheads 412(2) and 412(4) on print module 400 have an overlap 418, and printhead 412(4) on print module 400 has an overlap 420 with printhead 414 on print module 402.

Exemplary Wiper Assemblies

Figure 5:
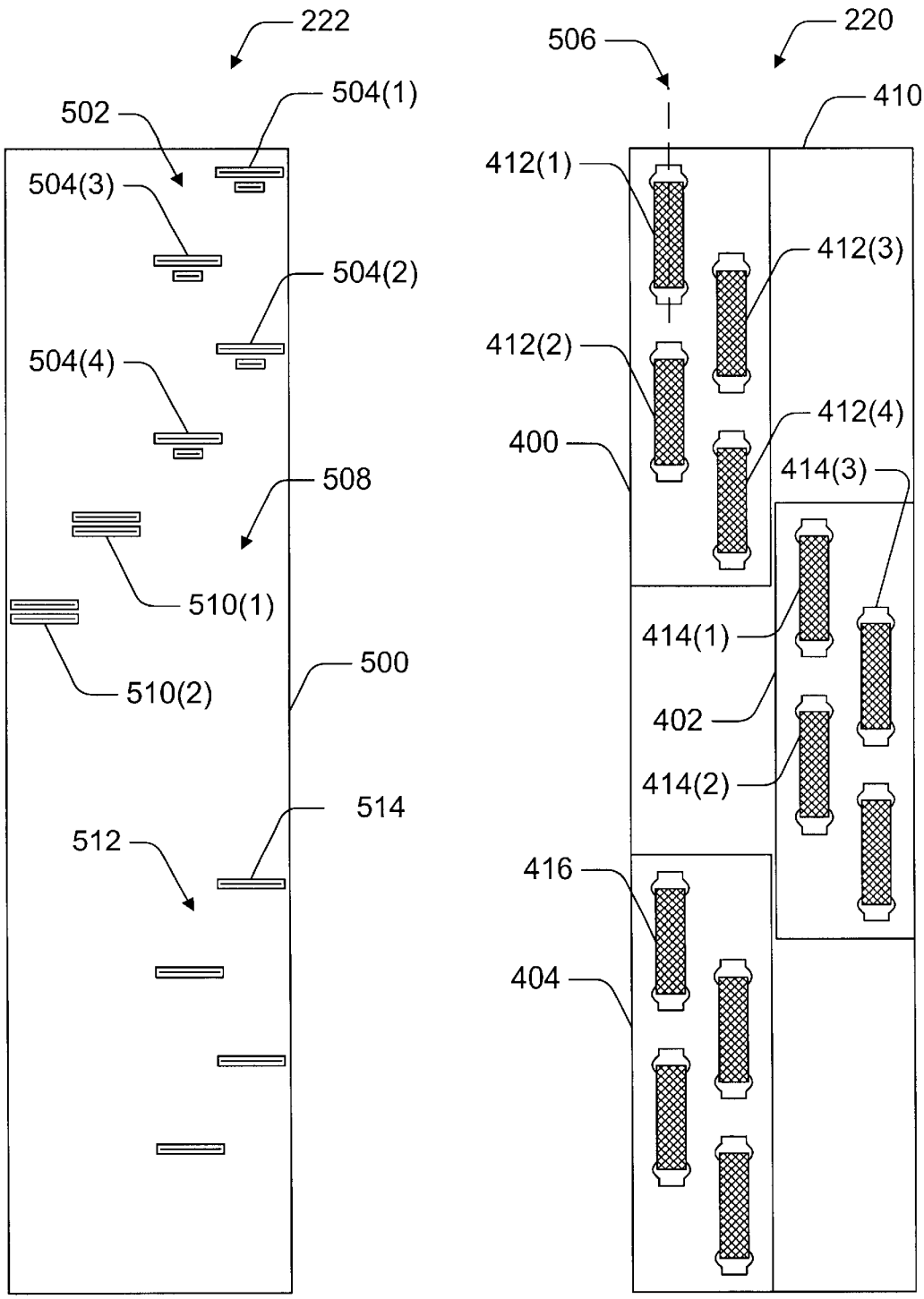
FIG. 5 is an illustration of a wiper assembly having various wiper configurations that correspond to printheads on a printbar assembly.

FIG. 5 illustrates components of an exemplary wiper assembly 222. The wiper assembly is shown adjacent printbar assembly 220 that is also illustrated in FIG. 4. FIG. 5 illustrates an exemplary alignment and configuration of wiper components on the wiper assembly 222 with corresponding printheads on the printbar assembly 220.

Wiper assembly 222 has a framework 500 to support the wiper components, and to install the wiper assembly in a printing device. Those skilled in the art will recognize that any number of varying framework configurations can be implemented to support the wiper components, and the wiper assembly in a printing device. Wiper assembly 222 can also include a drive mechanism (not shown) that facilitates the wiper assembly being positioned in proximity to a print bar assembly 220 such that wiper components on the wiper assembly 222 can contact and clean corresponding printheads on the printbar assembly 220. The drive mechanism can comprise any conventional drive coupling device that is mechanically coupled to and powered by a separate power source, such as a motor.

Wiper assembly 222 is shown having varying wiper component configurations in different regions of the wiper assembly, although it should be recognized that in practice, the wiper components would be standardized on the wiper assembly. In a first region 502 of wiper assembly 222, wipers 504 are illustrated in a configuration having two wipers, one having a width corresponding to one-half the width of a print module 400, and the other wiper having a width corresponding to the width of a printhead 412.

The wipers in region 502 correspond to the printheads 412 on print module 400. For example, wipers 504(1) correspond to printhead 412(1) (when the printbar assembly is "flipped over" and positioned above the wiper assembly, or vice-versa). When wipers 504(1) are positioned to contact printhead 412(1), the wipers are moved across the printhead in a direction that is parallel to a longitudinal axis 506 of printhead 412(1) to remove any ink residue and other contaminants from the printhead. It should be recognized that the movement between the wipers and the printhead is relative, and that the printhead can be moved across the wipers in a parallel direction relative to the wipers to clean the printhead. Furthermore, for bi-directional wiping, the wipers 504(1) can be moved in a first direction that is parallel to a longitudinal axis 506 of printhead 412(1), and in a second direction that is opposite to the first direction, to clean printhead 412(1).

In region 502 of wiper assembly 222, individual wipers 504 correspond to each of the printheads 412 on print module 400. That is, wipers 504(1) clean printhead 412(1), wipers 504(2) clean printhead 412(2), wipers 504(3) clean printhead 412(3), and wipers 504(4) clean printhead 412(4) when the wipers contact the printheads and move in a direction that is parallel to a longitudinal axis of the printheads.

In a region 508 of wiper assembly 222, wipers are illustrated in a configuration having two wipers that both correspond to one-half the width of a print module, such that the printheads and the entire width of the print module is cleaned when wiped with the wipers. The wipers 510 in region 508 correspond to printheads 414 on print module 402, and each set of wipers 510 correspond to two of the printheads 414 that are aligned on print module 402. For example, wipers 510(1) clean printhead 414(1) and printhead 414(2) when the wipers contact the printheads and move in a direction that is parallel to a longitudinal axis of the printheads, such as longitudinal axis 506.

In a region 512 of wiper assembly 222, wipers are illustrated in a configuration having only one wiper that corresponds to one-half the width of a print module, such that the printheads and the entire width of the print module is cleaned when wiped with the wipers. The wipers in region 512 correspond to printheads 416 on print module 404, and an individual wiper 514 corresponds to one printhead 416 on print module 404.

Figure 6:
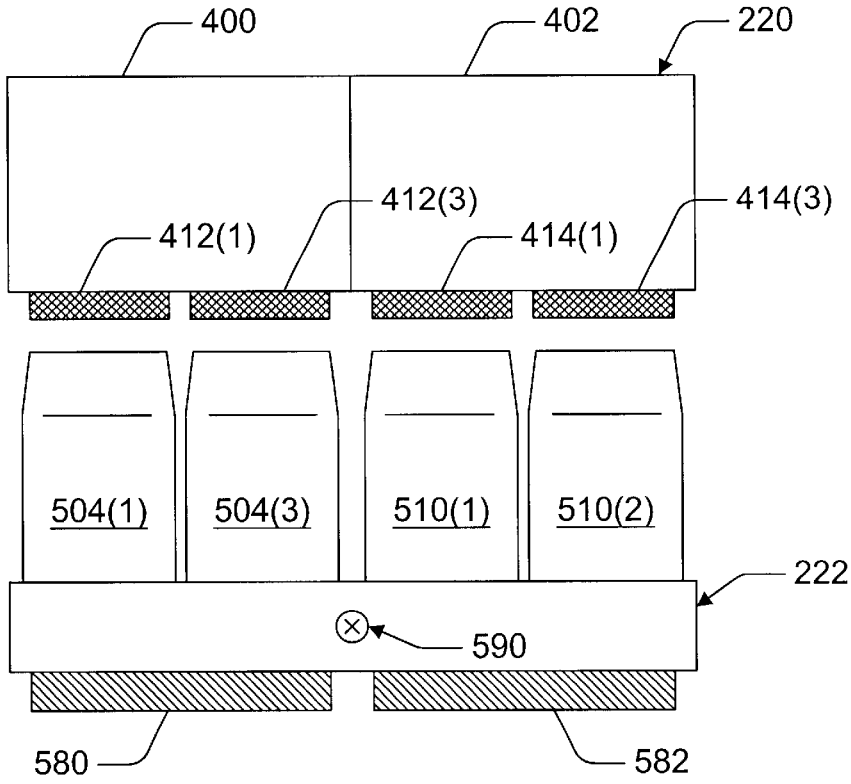
FIG. 6 is an illustration of a wiper assembly and wipers that correspond to printheads on a printbar assembly.

FIG. 6 illustrates an end-view of printbar assembly 220 and wiper assembly 222, such as shown in FIG. 5, positioned one over the other in proximity such that the wipers on wiper assembly 222 contact corresponding printheads on printbar assembly 220. For example, wipers 504(1) and 504(3) are positioned to contact and clean printheads 412(1) and 412(3) on print module 400, respectively. Additionally, wipers 510(1) and 510(2) are positioned and aligned to contact and clean printheads 414(1) and 414(3) on print module 402, respectively.

FIG. 6 also illustrates the wiper assembly 222 having printhead caps 580 and 582 to cover printheads 414 on print module 402 and printheads 412 on print module 400, respectively. The printhead caps 580 and 582 prevent ink in the nozzles of the printheads from drying when the printer is sitting idle, and prevent contaminants from collecting in the nozzles and on the printheads.

To position the caps 580 and 582 in proximity to the printheads for the purpose of engaging the printheads and the printhead caps, the wiper assembly 222 is designed to rotate about a central longitudinal axis 590. When wiper assembly 222 is rotated about axis 590, and the printhead caps are positioned to engage the printheads, either the wiper assembly 222 and/or the printbar assembly 220 can be moved in relation to the other to engage and cover the printheads with the printhead caps.

Figure 7:
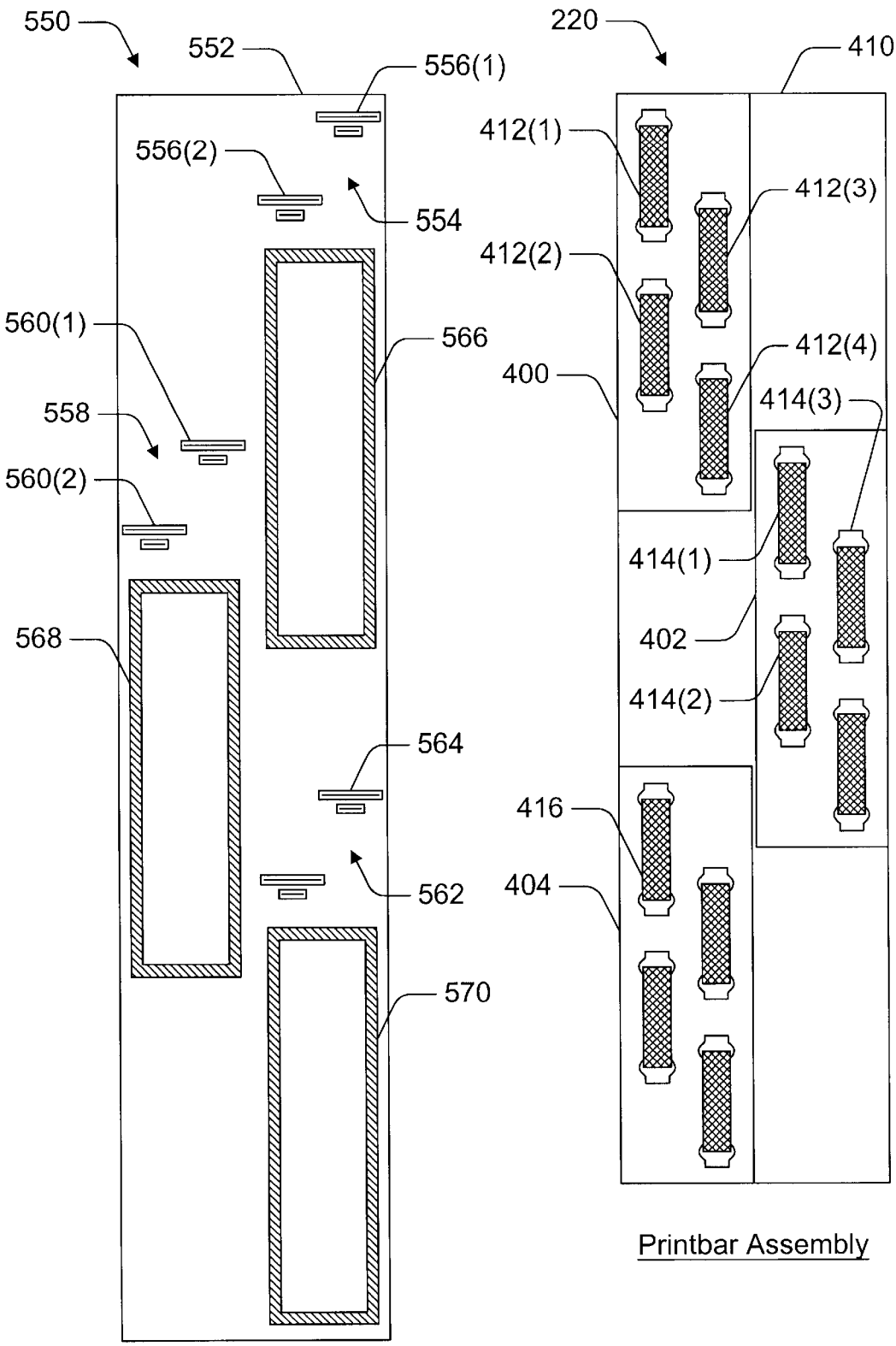
FIG. 7 is an illustration of a wiper assembly having wipers that correspond to printheads and printhead caps that correspond to print modules on a printbar assembly.

FIG. 7 illustrates components of an exemplary wiper assembly 550. The wiper assembly is shown adjacent printbar assembly 220 that is also illustrated in FIG. 4. FIG. 7 illustrates an exemplary alignment and configuration of wiper components and printhead caps on wiper assembly 550 with corresponding printheads on the printbar assembly 220.

Wiper assembly 550 has a framework 552 to support the wiper components and the printhead caps, and to install the wiper assembly in a printing device. Those skilled in the art will recognize that any number of varying framework configurations can be implemented to support the wiper components and the printhead caps, and the wiper assembly in a printing device.

Wiper assembly 550 can also include a drive mechanism (not shown) that facilitates the wiper assembly being positioned in proximity to a print bar assembly 220 such that wiper components on the wiper assembly 550 can contact and clean corresponding printheads on the printbar assembly 220. Wiper assembly 550 can also be positioned such that printhead caps on the wiper assembly engage and cover corresponding printheads and/or print modules on the printbar assembly 220. Either the wiper assembly 550 and/or the printbar assembly 220 can be moved in relation to the other to engage and cover the printheads with the printhead caps. The drive mechanism can comprise any conventional drive coupling device that is mechanically coupled to and powered by a separate power source, such as a motor.

Wiper assembly 550 has a first region 554 with wipers 556 illustrated in a configuration having two wipers, one having a width corresponding to one-half the width of a print module 400, and the other wiper having a width corresponding to the width of a printhead 412.

The wipers in region 554 correspond to the printheads 412 on print module 400. For example, wipers 556(1) correspond to printheads 412(1) and 412(2) (when the printbar assembly is "flipped over" and positioned above the wiper assembly, or vice-versa). When wipers 556(1) are positioned to contact printhead 412(1), the wipers are moved across the printhead in a direction that is parallel to a longitudinal axis 422 (FIG. 4) of the printhead to remove any ink residue and other contaminants from the printhead. It should be recognized that the movement between the wipers and the printhead is relative, and that the printhead can be moved across the wipers in a parallel direction relative to the wipers to clean the printhead. Furthermore, for bi-directional wiping, the wipers 556(1) can be moved in a first direction that is parallel to a longitudinal axis of printhead 412(1), and in a second direction that is opposite to the first direction, to clean printhead 412(1).

In a region 558 of wiper assembly 550, wipers 560 correspond to printheads 414 on print module 402, and each set of wipers 560 correspond to two of the printheads 414 that are aligned on print module 402. For example, wipers 560(1) clean printhead 414(1) and printhead 414(2) when the wipers contact the printheads and move in a direction that is parallel to a longitudinal axis 422 (FIG. 4) of the printheads. In a region 562 of wiper assembly 222, wipers 564 correspond to printheads 416 on print module 404.

Wiper assembly 550 also includes printhead caps 566, 568, and 570. The printhead caps are positioned on the wiper assembly between the wipers such that they do not interfere with cleaning the printheads on printbar assembly 220.

Printhead cap 566 on wiper assembly 550 corresponds to print module 400 on printbar assembly 220. When the wiper assembly 550 and printbar assembly 220 are positioned for capping the print modules and/or printheads, printhead cap 566 engages print module 400 to cover printheads 412 on the print module 400. Similarly, printhead cap 568 engages print module 402 to cover printheads 414, and printhead cap 570 engages print module 404 to cover printheads 416. It should be recognized that capping movement between the printbar assembly 220 and the wiper assembly 550 is relative, and that either or both of the assemblies can be moved such that the printhead caps cover the printheads.

Exemplary Wiper Configurations

Figure 8:
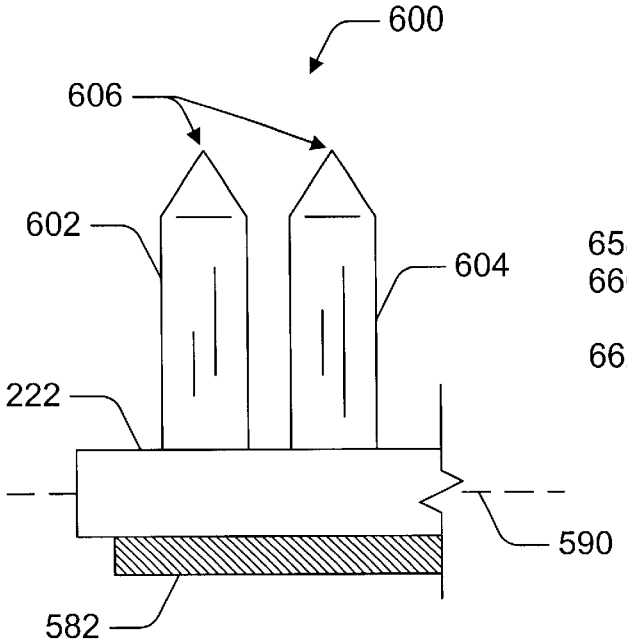
FIG. 8 is an illustration of a wiper assembly having a wiper configuration that includes two wipers.

FIG. 8 illustrates a section of a wiper assembly 222, such as shown in FIGS. 5 and 6, having a wiper configuration 600 that includes two wipers 602 and 604, although any number of wipers can be configured together to clean a corresponding printhead. FIG. 8 also illustrates a side-view section of printhead cap 582 and central longitudinal axis 590, as described above in reference to FIG. 6. The wipers 602 and 604 can be configured such as wipers 504 (FIG. 5), for example, where one wiper 602 corresponds to one-half the width of a print module 400, and the other wiper 604 has a width corresponding to the width of a printhead. Alternatively, the wipers can be configured such as wipers 510 (FIG. 5), where both wipers 602 and 604 are the same width and correspond to at least one-half the width of a print module.

Each of the wipers 602 and 604 have an elongated blade 606 that engages and wipes associated printhead nozzle sections to remove ink residue and build-up. The blade 606 of a wiper has sufficient width to wipe a cleaning path over all of the printhead nozzles in one pass across a corresponding printhead.

The wipers 602 and 604 can be formed of a resilient, non-abrasive, elastomeric material, such as nitrile rubber, ethylene polypropylene diene monomer (EPDM), or other comparable materials. Those skilled in the art will recognize that the wipers can be made with any number of varying materials, and combinations of materials.

Figure 9:
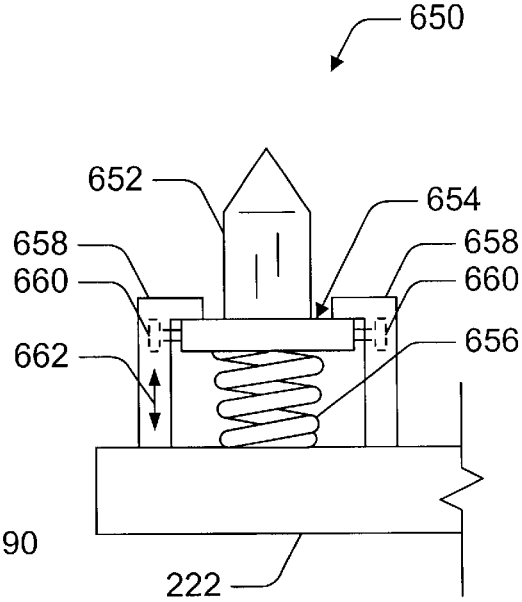
FIG. 9 is an illustration of a wiper assembly having a wiper configuration that includes a spring to apply pressure and hold a wiper in contact with a printhead.

FIG. 9 illustrates a section of a wiper assembly 222 having a wiper configuration 650 that includes a wiper 652 and a spring assembly 654. The configuration 650 can also include any number of wipers positioned together to clean a corresponding printhead, such as two wipers together as shown in configuration 600 (FIG. 8). The spring assembly 654 includes a spring 656 that applies a pressure, or force, to hold the wiper 652 in contact with a printhead while cleaning the printhead. The spring assembly 654 also includes guideposts 658 and slidable members 660 to align travel of the spring assembly in directions indicated by arrows 662.

Additionally, spring assembly 654 compensates for variations in spacing between the wiper assembly 222 and a corresponding printbar assembly that can be caused in part by manufacturing tolerances. Any spacing variations between a wiper assembly and a printbar assembly translate to spacing variations between a wiper and a printhead which can impair the cleaning effectiveness of the wiper due to inadequate contact with the printhead.

Exemplary Hinged Printbar Assembly

Figure 10:
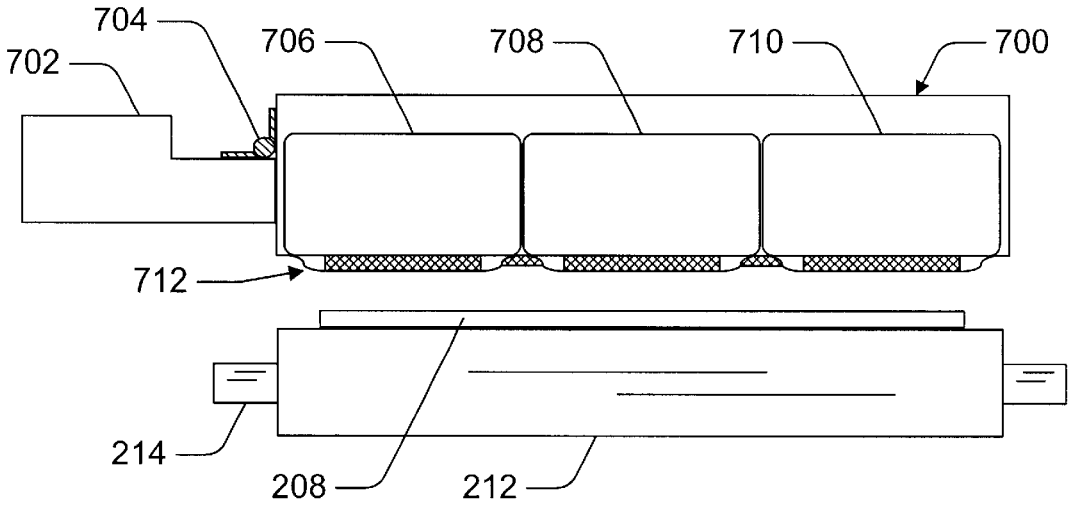
FIG. 10 is an illustration of a hinged printbar assembly in a print position.

FIG. 10 illustrates an exemplary hinged printbar assembly 700. The printbar assembly 700 is coupled to a fixed member 702 via a hinge 704. The fixed member 702 can be a component of a print unit in a printing device, part of a framework structure of the printing device, or the like.

The hinged printbar assembly 700 has print modules 706, 708, and 710, each having printheads 712. The printheads 712 of the print modules collectively span a width of a print media 208 when the hinged printbar assembly 700 is positioned in the print position, as shown in FIG. 10. Print media 208 is shown from an end-view and is routed in a printing device via the media routing belt 212 (FIG. 2).

Figure 11:
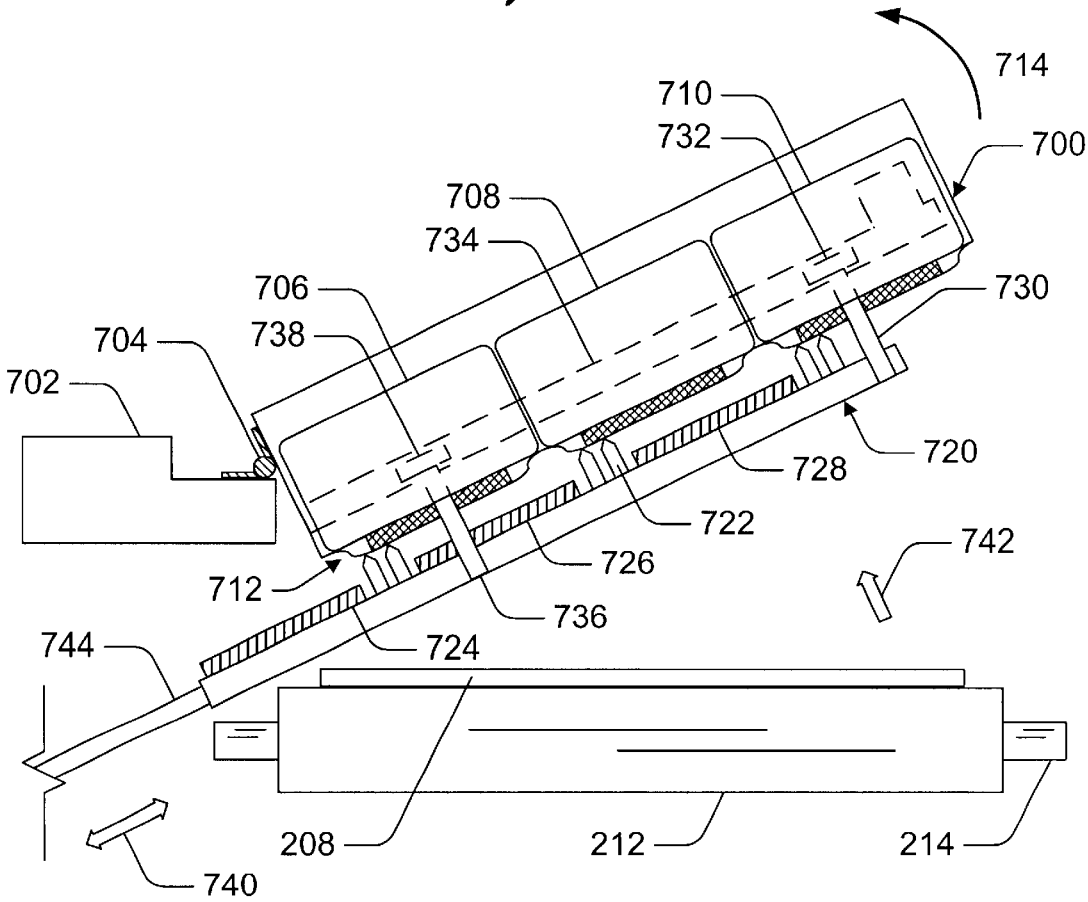
FIG. 11 is an illustration of a hinged printbar assembly in a service position and a corresponding wiper assembly.

FIG. 11 illustrates that print modules 706, 708, and 710 collectively pivot about hinge 704 in a direction indicated by arrow 714 to a service position. Pivoting the hinged printbar assembly 700 to the service position provides service access to the printheads 712. The wiper assembly 720 has wipers 722 that clean the printheads 712 when the wiper assembly is moved in a direction that is parallel to a longitudinal axis 422 (FIG. 4) of the printheads. For bi-directional wiping, the wiper assembly can be moved in a first direction that is parallel to a longitudinal axis of the printheads, and in a second direction that is opposite to the first direction, to clean the printheads.

Wiper assembly 720 also includes printhead caps 724, 726, and 728 that engage the print modules 706, 708, and 710, respectively, to cover the printheads 712. Either the wiper assembly 720 and/or the printbar assembly 700 can be moved in relation to the other to engage and cover the printheads with the printhead caps.

Wiper assembly 720 has a support 730 connected to a guidable member 732 that slides, or otherwise engages, a guide 734 of hinged printbar assembly 700. The guide 734 can be a channel guide within the hinged printbar assembly 700, a guide component configured external to the hinged printbar assembly, or any other type of wiper assembly servicing guide. Optionally, the wiper assembly 720 can have a second support 736 connected to a guidable member 738 that also slides, or otherwise engages, the guide 734.

When guidable member 732 and/or 738 is engaged within guide 734, the guide and the guidable member(s) interact to maintain contact between wipers 722 and printheads 712 when the wiper assembly 720 moves in either direction indicated by arrow 740. Additionally, when wiper assembly 720 moves in a direction indicated by arrow 742, printhead caps 724, 726, and 728 engage and are held in place over the respective print modules.

FIG. 11 also illustrates a wiper assembly positioning mechanism 744 connected to, or otherwise coupled to, wiper assembly 720 that moves the wiper assembly in the directions indicated by arrows 740 and 742. Those skilled in the art will recognize that there are any number of guide and guidable member configurations, and any number of wiper assembly positioning mechanisms, that can be implemented in any number of printing devices to facilitate wiper assembly 720 servicing the hinged printbar assembly 700.

Methods for Servicing a Hinged Printbar Assembly

Figure 12:
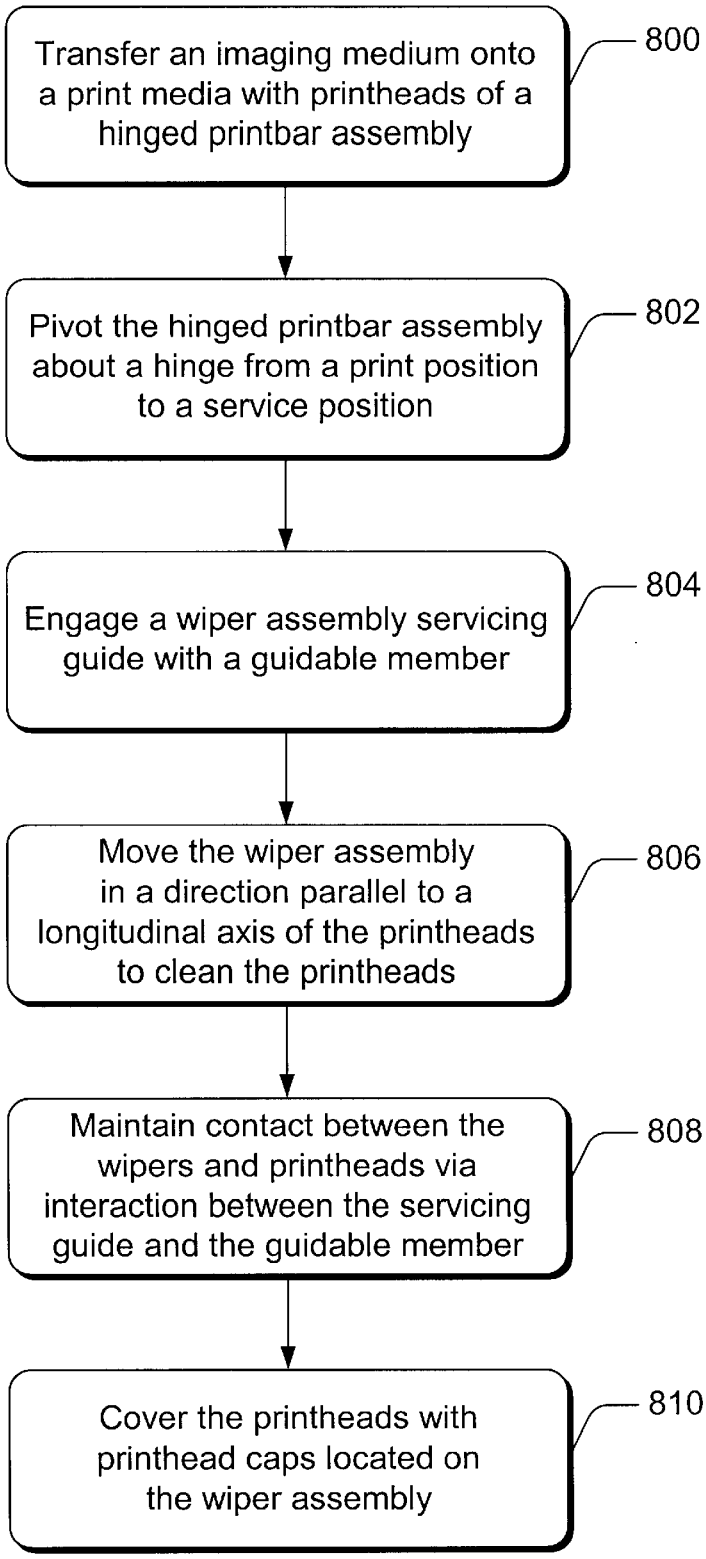
FIG. 12 is a flow diagram that describes a method for servicing a hinged printbar assembly.

FIG. 12 illustrates a method for servicing a hinged printbar assembly. The order in which the method is described is not intended to be construed as a limitation. Furthermore, the method can be implemented in any suitable hardware, software, firmware, or combination thereof. In addition, the method can be implemented by one or more processors executing instructions that are maintained on a computer-readable media.

At block 800, an imaging medium, such as ink, is transferred onto a print media with printheads of a hinged printbar assembly. A print module has one or more printheads, and one or more print modules are coupled to the hinged printbar assembly. The printheads of the print modules collectively span a width of the print media when the hinged printbar assembly is in a print position.

At block 802, the hinged printbar assembly is pivoted about a hinge from the print position to a service position. In the service position, the printheads of the hinged printbar assembly are accessible for cleaning. At block 804, a wiper assembly guidable member engages a wiper assembly servicing guide to position the wiper assembly in a service position. The guide can be a channel guide in the hinged printbar assembly, a guide on the framework of the hinged printbar assembly, or any other type of wiper assembly servicing guide. In the service position, wipers on the wiper assembly contact the printheads on the hinged printbar assembly.

At block 806, the wiper assembly is moved in a direction parallel to a longitudinal axis of the printheads such that the wipers on the wiper assembly clean the printheads. For bi-directional wiping, the wiper assembly can be moved in a first direction, and then in a second direction opposite to the first direction to clean the printheads. At block 808, contact between the wipers on the wiper assembly and the printheads is maintained by the interaction of the guidable member and the wiper assembly servicing guide when the wiper assembly is moved to clean the printheads.

At block 810, the wiper assembly is positioned such that the printhead caps on the wiper assembly engage the print modules on the hinged printbar assembly and cover the corresponding printheads. The capping movement between the printbar assembly and the wiper assembly is relative, such that either or both of the assemblies can be moved to cover the printheads with the printhead caps.

Conclusion

A printbar assembly can be pivoted about a hinge from a print position to a service position to provide service access to printheads on the printbar assembly. In the service position, a wiper assembly can engage the printbar assembly to clean the printheads with wipers and/or cover the printheads with printhead caps.

Although the invention has been described in language specific to structural features and/or methodological steps, it is to be understood that the invention defined in the appended claims is not necessarily limited to the specific features or steps described. Rather, the specific features and steps are disclosed as preferred forms of implementing the claimed invention.

What is claimed is:

1. An inkjet printing mechanism, comprising:

one or more hinged printbar assemblies, an individual hinged printbar assembly configured to pivot about a hinge between a print position and a service position;

one or more print modules coupled to the individual hinged printbar assembly, an individual print module having one or more printheads, the one or more printheads of the one or more print modules collectively configured to span a width of a print media when the individual hinged printbar assembly is in the print position; and one or more wiper assemblies, an individual wiper assembly configured to service printheads on the individual hinged printbar assembly, the individual wiper assembly including a guidable member configured to engage a guide of the individual hinged printbar assembly.

2. An inkjet printing mechanism as recited in claim 1, wherein the one or more hinged printbar assemblies are collectively configured to be pivoted about the hinge.

3. An inkjet printing mechanism as recited in claim 1, wherein the one or more wiper assemblies are collectively configured to service the printheads on the one or more hinged printbar assemblies.

4. An inkjet printing mechanism as recited in claim 1, wherein the one or more hinged printbar assemblies are collectively configured to be pivoted about the hinge from the print position to the service position, and wherein the one or more wiper assemblies are collectively configured to service the printheads on the one or more hinged printbar assemblies.

5. An inkjet printing mechanism as recited in claim 1, wherein the guidable member is a slidable member of the individual wiper assembly configured to engage the guide of the individual hinged printbar assembly.

6. An inkjet printing mechanism as recited in claim 1, wherein the guide is a channel guide in the individual hinged printbar assembly that engages the guidable member of the individual wiper assembly.

7. An inkjet printing mechanism as recited in claim 1, wherein the guide is a wiper assembly servicing guide in the individual hinged printbar assembly that engages the guidable member of the individual wiper assembly.

8. An inkjet printing mechanism as recited in claim 1, wherein the guidable member of the individual wiper assembly is configured to engage the guide of the individual hinged printbar assembly in the service position, and wherein the individual wiper assembly further includes one or more wipers configured to clean the one or more printheads on the individual hinged printbar assembly.

9. An inkjet printing mechanism as recited in claim 1, wherein the individual wiper assembly includes one or more wipers configured to clean the one or more printheads on the individual hinged printbar assembly, and wherein the guide and the guidable member are configured for interaction to maintain contact between the one or more wipers and the one or more printheads.

10. An inkjet printing mechanism as recited in claim 1, wherein the individual wiper assembly includes one or more printhead caps configured to cover the one or more printheads on the individual hinged printbar assembly.

11. A hinged printbar assembly, comprising:

a framework that includes a guide configured to engage a guidable member of a wiper assembly;

one or more print modules coupled to the framework, an individual print module having one or more printheads, the one or more printheads of the one or more print modules collectively configured to span a print region in a print position; and a hinge configured to couple the framework to a fixed member, wherein the one or more print modules are collectively configured to pivot about the hinge between the print position and a service position.

12. A hinged printbar assembly as recited in claim 11, wherein the guidable member is a slidable member of the wiper assembly that engages the guide of the framework.

13. A hinged printbar assembly as recited in claim 11, wherein the guide is a channel guide in the framework configured to engage the guidable member of the wiper assembly when the one or more print modules are in the service position.

14. A hinged printbar assembly as recited in claim 11, wherein the guide is an external guide of the framework configured to engage the guidable member of the wiper assembly when the one or more print modules are in the service position.

15. A hinged printbar assembly as recited in claim 11, wherein the wiper assembly includes one or more wipers configured to clean the one or more printheads of the one or more print modules, and wherein the guide and the guidable member are configured for interaction to maintain contact between the one or more wipers and the one or more printheads.

16. A hinged printbar assembly as recited in claim 11, wherein the wiper assembly includes one or more printhead caps configured to engage the one or more print modules and cover the one or more printheads, and wherein the guide and the guidable member are configured for interaction to secure the one or more printhead caps over the one or more printheads.

17. A method, comprising:

transferring an imaging medium onto a print media with one or more printheads of a printbar assembly in a print position, the one or more printheads collectively spanning a width of the print media;

pivoting the one or more printheads about a hinge between the print position and a service position;

engaging a guide of the printbar assembly with a guidable member of a wiper assembly; and servicing the one or more printheads with a the wiper assembly when the one or more printheads are in the service position.

18. A method as recited in claim 17, wherein pivoting comprises pivoting the printbar assembly about the hinge to collectively pivot the one or more printheads.

19. A method as recited in claim 17, wherein the guidable member is a slidable member of the wiper assembly that engages the guide of the printbar assembly.

20. A method as recited in claim 17, wherein the guide is a channel guide in the printbar assembly that can be engaged with the guidable member of the wiper assembly.

21. A method as recited in claim 17, wherein the guide is a wiper assembly servicing guide that can be engaged with a the guidable member of the wiper assembly.

22. A method as recited in claim 17, further comprising maintaining contact between the one or more printheads and the wiper assembly via an interaction of the guide and the guidable member.

23. A method as recited in claim 17, wherein servicing comprises cleaning the one or more printheads with one or more wipers coupled to the wiper assembly.

24. A method as recited in claim 17, wherein servicing comprises cleaning the one or more printheads with one or more wipers coupled to the wiper assembly, and further comprises maintaining contact between the one or more wipers and the one or more printheads when said engaging the guide of the printbar assembly with the guidable member of the wiper assembly.

25. A method as recited in claim 17, further comprising covering the one or more printheads with one or more printhead caps coupled to the wiper assembly.

26. A method for servicing an inkjet printhead on a printbar assembly in an inkjet printing device, the method comprising:

pivoting the inkjet printhead about a hinge from a print position to a service position;

engaging a guide of the printbar assembly with a guidable member of a wiper assembly; and cleaning the inkjet printhead with one or more wipers on the wiper assembly by moving the wiper assembly in a direction parallel to a longitudinal axis of the inkjet printhead.

27. A method as recited in claim 26, wherein pivoting comprises pivoting the printbar assembly about the hinge.

28. A method as recited in claim 26, wherein engaging comprises maintaining contact between the one or more wipers and the inkjet printhead.

29. A method as recited in claim 26, further comprising covering the inkjet printhead with a printhead cap on the wiper assembly.

* * * * *

UNITED STATES PATENT AND TRADEMARK OFFICE

CERTIFICATE OF CORRECTION

PATENT NO. : 6,637,858 B2
DATED : October 28, 2003
INVENTOR(S) : Wotton et al.

It is certified that error appears in the above-identified patent and that said Letters Patent is hereby corrected as shown below:

Column 13,
Line 32, delete "a".

Signed and Sealed this

Second Day of November, 2004

JON W. DUDAS
*Director of the United States Patent and Trademark Office*